US005517805A

United States Patent [19]

Epstein

[11] Patent Number: 5,517,805

[45] Date of Patent: May 21, 1996

[54] VACUUM-PACKAGING MACHINE WITH TRANSLATING TOOLS

[76] Inventor: Moshe Epstein, 2530 Queensway, Northbrook, Ill. 60062

[21] Appl. No.: 335,644

[22] Filed: Nov. 8, 1994

[51] Int. Cl.[6] ..... B65B 41/12; B65B 47/02; B65B 65/02

[52] U.S. Cl. ..... 53/453; 53/559; 53/579

[58] Field of Search ..... 53/453, 559, 561, 53/579, 578, 456

[56] References Cited

U.S. PATENT DOCUMENTS

| | | | |
|---|---|---|---|
| 3,808,772 | 5/1974 | Turtschan | 53/578 X |
| 4,209,957 | 7/1980 | Utzmann | 53/453 |
| 4,329,830 | 5/1982 | Omori | 53/453 |
| 4,840,691 | 6/1989 | Knape | 53/453 X |
| 4,951,444 | 8/1990 | Epstein | 53/77 |
| 5,170,611 | 12/1992 | Buchko et al. | 53/453 |

OTHER PUBLICATIONS

"The Tiromat VA"; Kramer & Grebe product literature. (No Date).

*Primary Examiner*—James F. Coan

*Attorney, Agent, or Firm*—Milton S. Gerstein; Marvin N. Benn

[57] ABSTRACT

A vacuum-packaging machine is provided with a drive mechanism for each of the tools at the forming and sealing stations that not only vertically reciprocate the tools, but which also horizontally reciprocate the tools. Before the next section of the film being processed reaches the forming or sealing station, the respective tool at each station is moved in the same direction as the film, while being simultaneously lifted up toward the film. As that section comes to a halt at the station, the tool is already raised into close juxtaposition to the film for performing its work. The tool is then raised the final quantum amount in order to start either the forming or the sealing process. As soon as the forming or sealing process has been completed, both the conveyer chain and the tools are actuated for forward, downstream movement. The tools, in addition to their forward, horizontal movement, also drop down, in order to clear the packages to allow unobstructed passage of the film.

15 Claims, 7 Drawing Sheets

VACUUM-PACKAGING MACHINE WITH TRANSLATING TOOLS

BACKGROUND OF THE INVENTION

The present invention is directed to a vacuum-packaging machine, which continually forms packages from two layers of thin film conveyed to different stations by means of a conveyer, at which stations separate processes are performed. The packages formed may, or may not, be vacuum-packed. The typical vacuum-packaging machine has a first, forming station where a lower film is formed into a plurality of pockets, or main holding sections, of the plurality of packages being formed at any one time. From this first, forming station, the film is transferred to a second, loading station, where the actual product to be packaged is placed in the previously-formed pockets at the first station. After loading, the film is transferred, or indexed, to a third, sealing station, where an upper film is placed on top of the lower film, which has already been formed into pockets and loaded with product, which upper film is then sealed to the lower film, to thereby form a plurality of sealed vacuum-packages. Finally, the joined, sealed packages are conveyed to a fourth, cutting station, where the joined packages are cut into individual vacuum-packages for shipment and/or storage. The sealing station may be provided with two, separate, sealing sub-sections, as disclosed in U.S. Pat. No. 4,951,444, where an initial seal is followed by a final seal. It is at the forming station and the sealing station where the greatest amount of time is spent, since the film must come to a rest and await the completion of the respective process, before the conveyer can again index the film; thus, the productivity of the machine is limited by the amount of dwelling time spent at these two stations.

At each of the forming and sealing stations above-mentioned, there is a dedicated tool-head, which is lifted toward the film in order to perform either the forming or sealing process. After the specific task has been completed, the tool is then lowered, and then raised again after the conveyer has indexed another portion of the film to that station. As disclosed in U.S. Pat. No. 4,951,444, the raising of these tools is commenced prior to the time that the actual indexing of the film has been completed, i.e., while the conveyer is still transporting the film, before the section of the film to be processed next has completely reached and become stationary at the station, in order that a considerable amount of time be saved. The amount of time saved by such preactuation of the tools is considerable, resulting in marked increases in productivity.

The present invention is directed to further increases in the productivity of vacuum-packaging machines.

SUMMARY OF THE INVENTION

It is the primary objective of the present invention to provide a vacuum-packaging machine, or packaging machine providing packages that are not vacuum-sealed, having much greater productivity than hithertofore possible, by reducing the dwell-time at each of the forming and sealing stations.

It is another objective of the present invention to provide such increased productivity by translating the tools at each of the forming and sealing stations in addition to their normal, vertical movement, which translating movement allows for earlier indexing of the film by the conveyer so that the stationary dwell time at each station is greatly reduced.

According to the invention, there is provided a vacuum-packaging machine which has a drive mechanism for each of the tools at the forming and sealing stations that, not only vertically reciprocate the tools, but which also horizontally reciprocate the tools. Before the next section of the film being processed reaches the forming or sealing station, the respective tool at each station is moved in the same direction as the film, while being simultaneously lifted up toward the film. As that film-section comes to a halt at the station, the tools are already raised into close juxtaposition to the film for performing their work. The tools are then raised the final quantum amount in order to start either the forming or the sealing process. As soon as the forming or sealing process has been completed, both the conveyer chain and the tools are actuated for forward movement. The tools, in addition to their forward, horizontal movement, also drop down, in order to clear the packages, in order to allow unobstructed. passage of the film, and, also, in order to return to their original state for the next section of the film to be processed.

BRIEF DESCRIPTION OF THE DRAWINGS

The invention will be more readily understood with reference to the accompanying drawing, wherein.

DETAILED DESCRIPTION OF THE INVENTION

Figure 1:
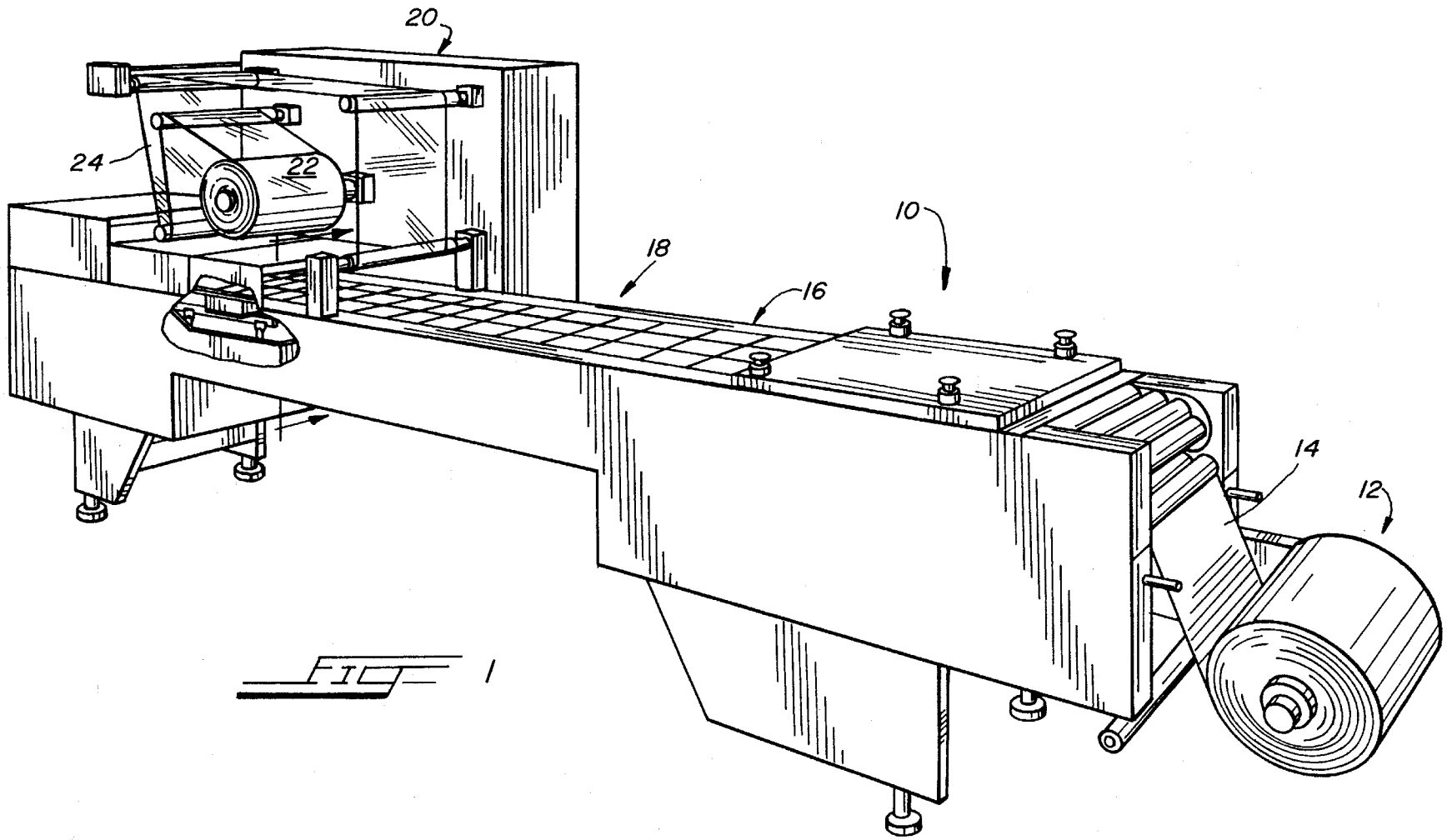
FIG. 1 is an isometric view of a vacuum-packaging machine incorporating the translating tools of the invention.

Referring now to the drawings in greater detail, there is shown in FIG. 1 a vacuum-packaging machine 10, which incorporates therein the improved tools and drives therefor. The machine 10 has a film-supply 12 for storing and unwinding plastic film 14, which film 14 constitutes the lower layer of the finished vacuum-packages. From the supply 12, the film is directed to a forming station 16, at which the film is formed into a plurality of pocket-shaped receptacles. At the forming station, a plurality of such pockets are formed, each to be part of a finished vacuum-package. The pockets are formed by the raising of a tool against the bottom of the film. The tool, or mold, has a plurality of hollow cavities in which the film is to be formed to the desired shape for forming a plurality of packages. The mold is provided with suction holes for drawing the film into the plurality of cavities thereof. The heater in the mold also heats the film, so that it becomes deformable, and, therefore, easily molded into the proper, receptacle-like shape by means of the vacuum thereof, which sucks the film into the cavities of the mold. After sufficient time has elapsed, the vacuum is terminated, and the tool is lowered, in order to allow for the film to be advanced again by means of the conveyer chain of the machine. From the forming station, the chain conveys the film to a loading station 18, where each pocket that was formed at the forming station is filled with the product being packaged. From the loading station, the conveyer indexes the film for advancing the loaded pocket-receptacles to a sealing station 20. At the sealing station, a second supply roll 22 of plastic film 24 is provided. The film 24 constitutes the upper layer of the finished vacuum packages, and is unrolled from the supply 22 to a location juxtapositioned above the product-filled pocket-receptacles. At the sealing station, the upper film is heat-sealed to the lower-film, during which sealing, a vacuum is formed in the packages. The seal is formed at the sealing station by a tool typically consisting of a heat-sealing section, which is brought into and out of engagement with the lower film. An upper stationary tool with a heated reaction plate heats the upper film, and allows for the heated, upper rim of the bottom heat-sealer to abut thereagainst during the heat-sealing process. The lower, heat-sealing tool-sections are conventionally raised up against the lower film for heat-sealing, and after heat-sealing, are lowered. As disclosed in U.S. Pat. No. 4,951,444, the raising of the lower heat-sealing tool is commenced prior to the time that the actual indexing of the film has been completed, i.e., while the conveyer is still transporting the film to the sealing station, before the section of the film to be processed next has completely reached and become stationary at the sealing station, in order that a considerable amount of time be saved. According to the present invention, the lower heat-sealing tool, as well as the receptacle-forming mold or tool at the forming station 16, are also given additional, horizontal, translational movement, in order to save more time, as explained in detail hereinbelow.

Figure 2:
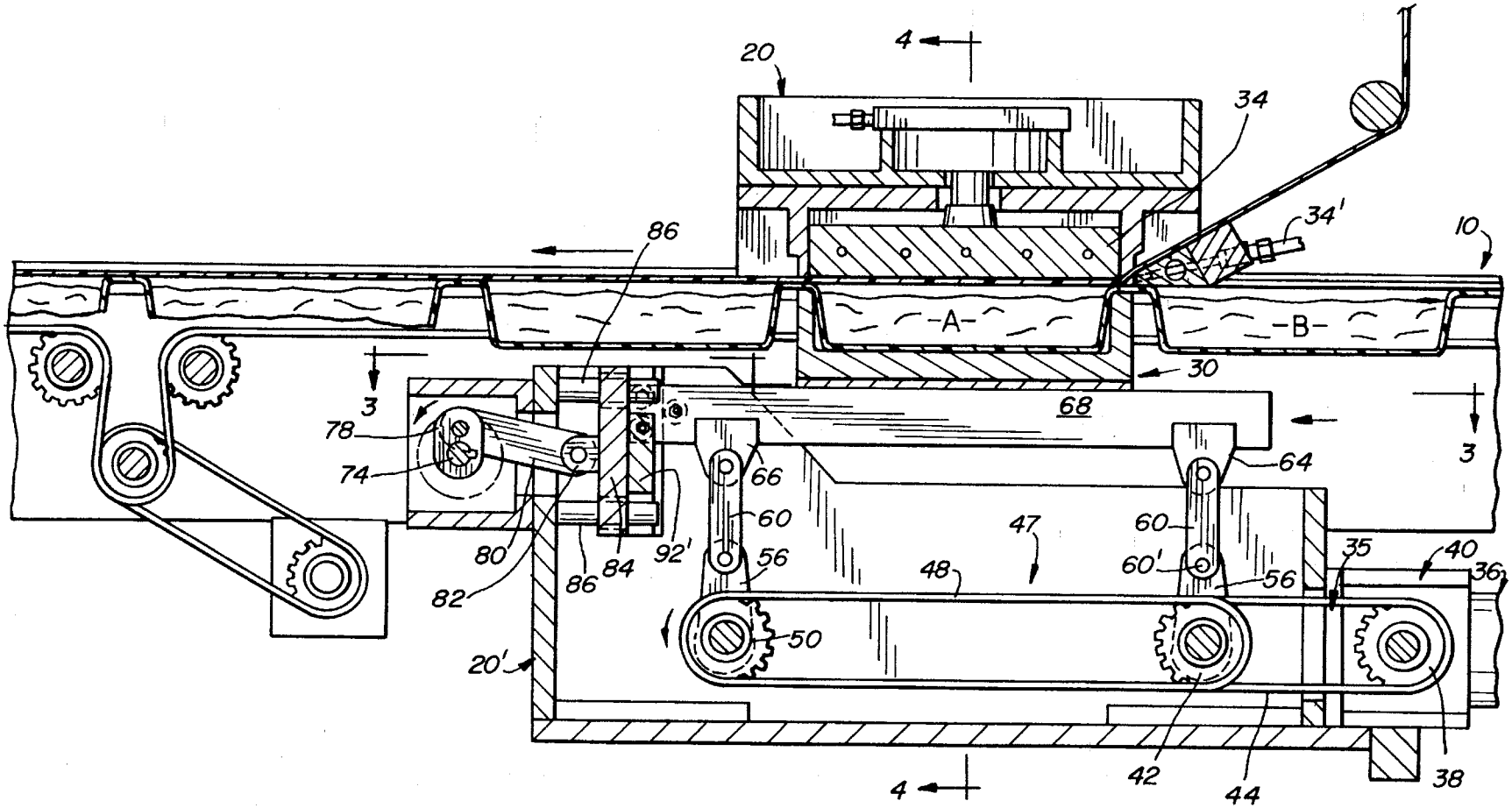
FIG. 2 is a longitudinal, cross-sectional view showing a station of the vacuum-packaging machine of FIG. 1, showing the translating tool thereat and the drive mechanism for providing to the tool both vertical and horizontal reciprocal motion, the tool being shown in its operative, film-engaging position.
Figure 3:
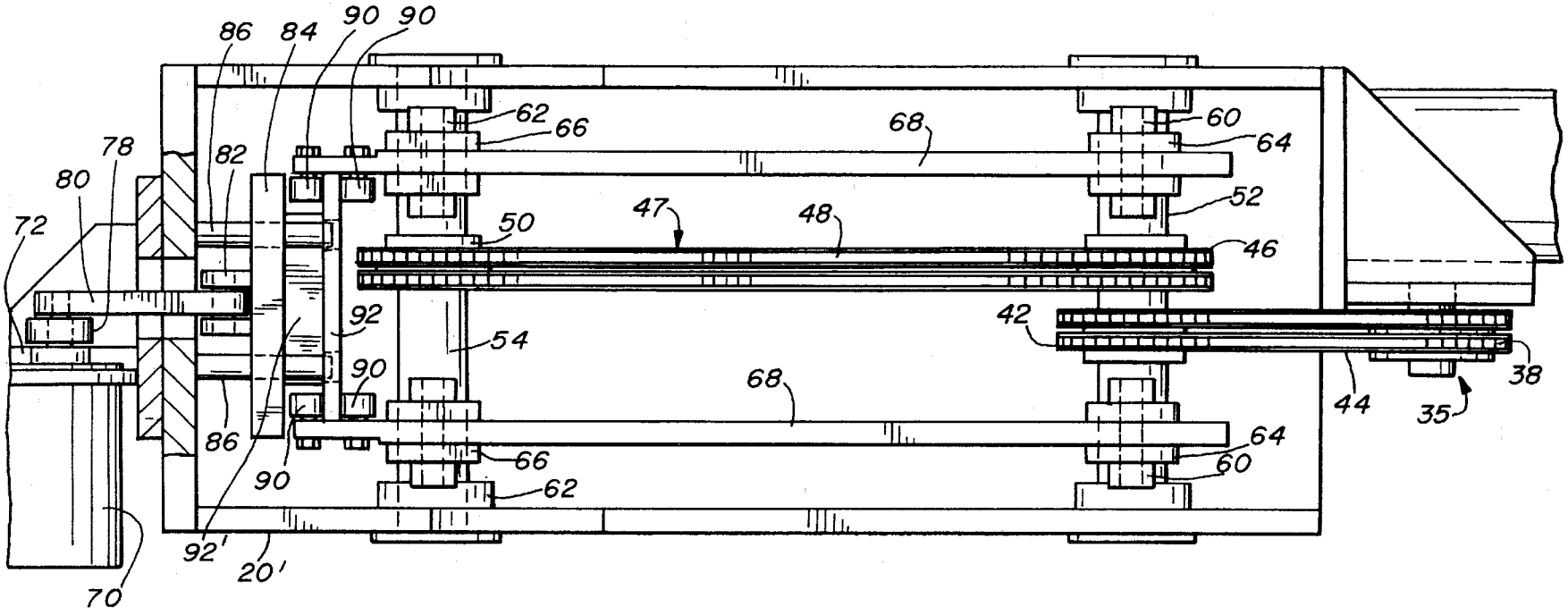
FIG. 3 is a cross-sectional view taken along line 3—3 of FIG. 2.
Figure 4:
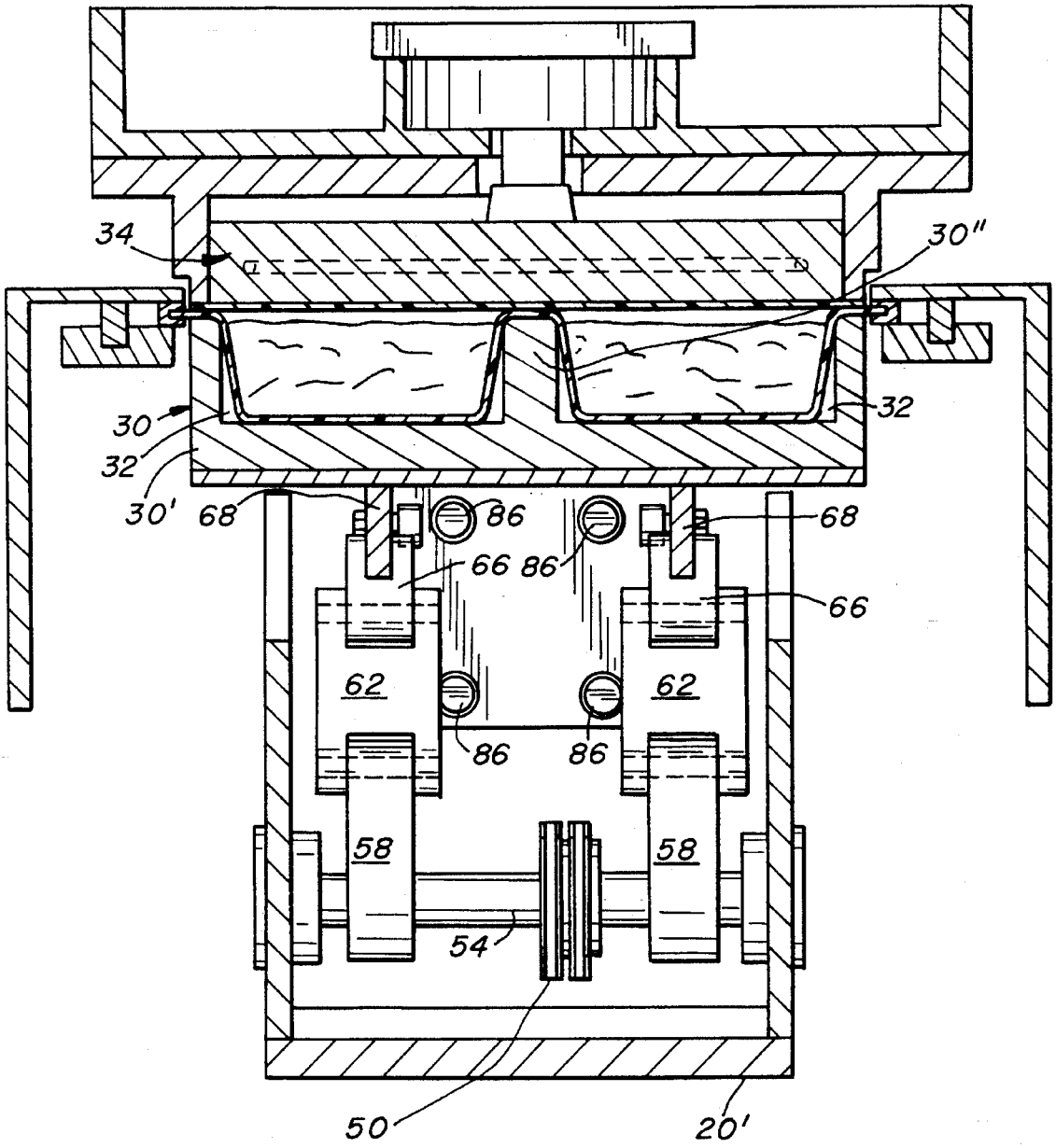
FIG. 4 is a cross-sectional view taken along line 4—4 of FIG. 2.

Referring to FIGS. 2–4, there is shown the invention adapted to the lower, heat-sealing tool 30 at the sealing station 20. It is to be understood that the following description is equally applicable to the receptacle-forming molding tool at the forming station 16. The sealing station has a main mounting frame 20' by which the heat-sealing tool and associated drive mechanism of the invention are mounted. The main frame 20' is positioned directly below the conveyed films and below the upper, stationary, tool 34. The lower heat-sealing tool 30 is made up of a main frame 30' which is divided along the width of the apparatus into two heat-sealing sections, separated by upstanding central section 30". The upper, heated surface of the main rim contacts against the bottom of the lower film juxtapositioned at the sealing station for heat-sealing the upper layer to the lower layer. Of course, more than two heat-sections may be provided in the heat-sealing tool 30. The heat-sealing tool 30, when in its operative, sealing-contact position with the film, defines cavities 32 in which is received the pocket-receptacle of the package, in which are stored the products being packaged. In this operative position, the upper rim-surface of the tool 30 is provided a reaction surface by the upper, stationary sealing tool 34, and whereby the packages may be evacuated during the heat-sealing process, as best seen in FIG. 4 by means of vacuum-forming tube 34' in the conventional manner. The tool 30, unlike the prior art, not only is reciprocated in the vertical direction toward and away from the film at the sealing station, but also undergoes a horizontal reciprocal motion. The drive mechanism for accomplishing this compound motion is described hereinbelow. The reason for the horizontal reciprocal motion is in order to shorten the dwell time of the film at the forming and sealing stations by forwardly moving the sealing tool 30 along with the conveyer transporting the film as soon as the sealing operation has been completed. By translating the sealing tool 30 along with the conveyance of the film, there is obviated the need for waiting until the sealing tool 30 has been lowered a sufficient amount so as to allow clearance for the passage of the packages. Since, according to the invention, the sealing tool 30, or the molding tool at the forming station, is translated along with the advancing film, the lowering of the tools to allow adequate clearance to the moving packages may be accomplished while the tools themselves are moving along with the film, as seen in FIGS. 2 and 3.

Figure 6:
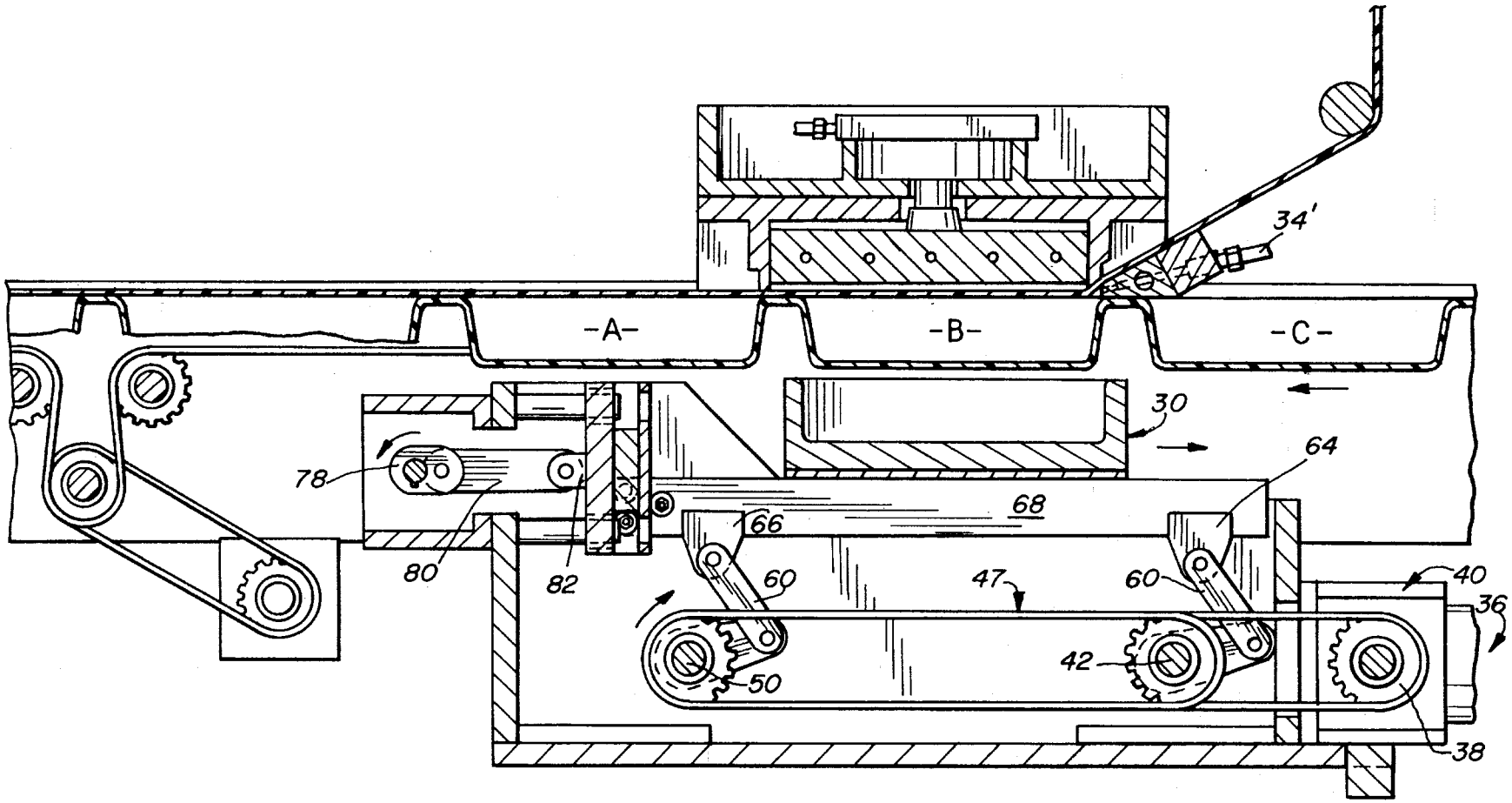
FIG. 6 is a longitudinal, cross-sectional view similar to that of FIG. 5, with the tool thereof being shown in an intermediate position where the tool has have been horizontally translated to its farthest upstream position, and with the tool still lowered.

The drive mechanism for moving the sealing tool 30 at the sealing station, or the mold at the forming station, in a compound motion, is accomplished by two separate drives. To achieve reciprocal, vertical motion, a vertical drive 36 is provided, and consists of a primary drive 35 having a drive pulley, or toothed wheel, 38 driven by a reversible motor 40 through a gear-reduction unit. The drive pulley 38 drives driven pulley 42 through the chain 44, which, in turn, drives pulley 46 forming part of the secondary drive chain 47. The pulley 46 drives chain 48, which, in turn, drives pulley 50. The pulleys 46, 50 of the secondary drive 47, respectively, rotate shafts 52, 54 coupled thereto. At the ends of each shaft 52, 54 are pivotally connected drive levers 56 and 58, respectively, which, in turn, are pivotally connected at their distal ends to the lower ends of intermediate, connecting links 60, 62, respectively, which, at their upper ends, are pivotally connected to yokes 64, 66, which yokes fixedly mount mounting plates 68 to which is permanently affixed the sealing or forming tool 30. Rotation of the drive motor 40 in a first direction causes the tool to be raised, as seen in FIG. 2, for performing either sealing or forming of the film, while rotation of the drive motor 40 in the second, opposite direction causes the tool to be lowered, as seen in FIG. 6, for awaiting the next indexing of the film. The drive motor 40 for the vertical drive mechanism is a D.C. servo-motor, such as Model R88G, manufactured by Pacific Scientific Co.

The drive train for achieving the horizontal reciprocal motion for the tool is achieved by a drive motor 70 mounted to the frame 20' of the vacuum-packaging machine at the forming or sealing station. The drive motor 70, through an appropriate gear reduction unit, rotatable drives disc 72. Projecting from the surface-face of the disc 72 is a drive shaft 74 which is keyed to an intermediate, eccentric link 78. The link 78 is pivotally coupled at its other end portion to one end of connecting link 80, which is pivotally coupled at its distal end to a yoke 82 affixed to a push-plate 84. The push-plate 84 has four corner holes for receiving therethrough four guide-rods 86, by which the push-plate 84 is guided for movement in the horizontal direction. The mounting plates 68, fixedly secured to the lower surface of the tool 30, are operatively coupled to the horizontal drive train for achieving the horizontal reciprocal motion of the tool. It is, of course, possible to use a piston-cylinder arrangement for reciprocating the push-plate 84. At one end of each mounting plate 68, there are provided horizontally-mounted rollers 90 which sandwich therebetween, and roll vertically along, a vertical guide plate 92. The guide plates are laterally spaced apart along the front surface-face of the push plate, and each is fixedly secured to the front surface-face by means of a gusset plate 92'. Thus, as the push-plate 84 is driven in either horizontal direction, the mounting plates 68, via the connection with the guide plates 92, are moved therewith, while the vertical motion of the tool is accommodated by means of the roller-connection between the rollers 90 and the guide plates 92. The drive motor 70 for the horizontal drive mechanism is a D.C. servo-motor, such as Model R65H, manufactured by Pacific Scientific Co., which is the same type of servo-motor used for driving the film-conveyer chain.

The process-cycle of each of the horizontal and vertical reciprocal drive mechanisms be readily understood by comparing FIGS. 2, 5, 6 and 7. In FIG. 2, the heat-sealing tool 30 is raised to its uppermost position, where its heated, upper rim-surfaces contact against the lower film indexed to the sealing station. As can be seen, the tool 30, with its upper rim 30', receives a pocket-receptacle of the package being heat-sealed in the hollow, interior volume of the sealing tool. In this state, the bottom film-portion 13 is retained within the hollow interior of the tool by means of suction holes formed in the bottom surface 30" of the sealing tool, in the conventional manner. This allows the interior of the package to be evacuated by means of the upper nozzle 34' (FIG. 2) prior to the heat-sealing process, in the conventional manner. In this heat-sealing state, the vertical drive mechanism's connecting linkages 60, 62 are in their completely vertical orientation, while the horizontal drive mechanism's push-plate 84 is located approximately at its middle portion of travel along the guide-rods 86. The heat-sealing tool 30 or the forming mold-tool at the forming station, is allowed to dwell for a small time in its uppermost, work-performing position, in order, in the case of the heat-sealing tool, to accomplish proper heat-sealing of the upper and lower films along the circumferences thereof. This dwell time is achieved by stopping the vertical drive motor 40 before its actuation into its reverse mode for lowering the tool, and by stopping the horizontal drive motor 70 for the requisite amount of time.

Figure 5:
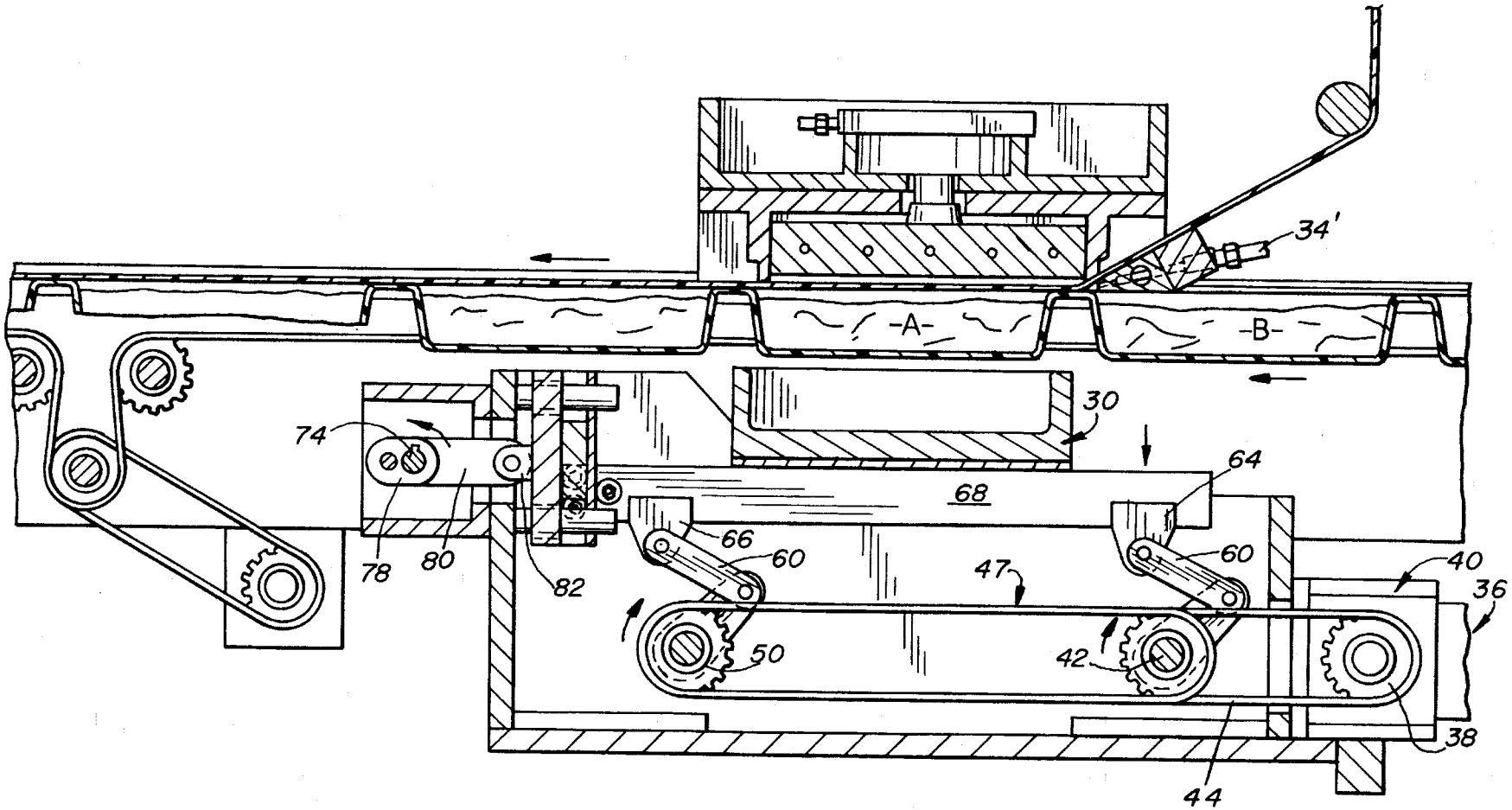
FIG. 5 is a longitudinal, cross-sectional view similar to that of FIG. 2, with the tool thereof being shown in its intermediate position after having just processed the film at the station, and having been moved in the same direction as the chain and downwardly therefrom for allowing clearance therepast.
Figure 7:
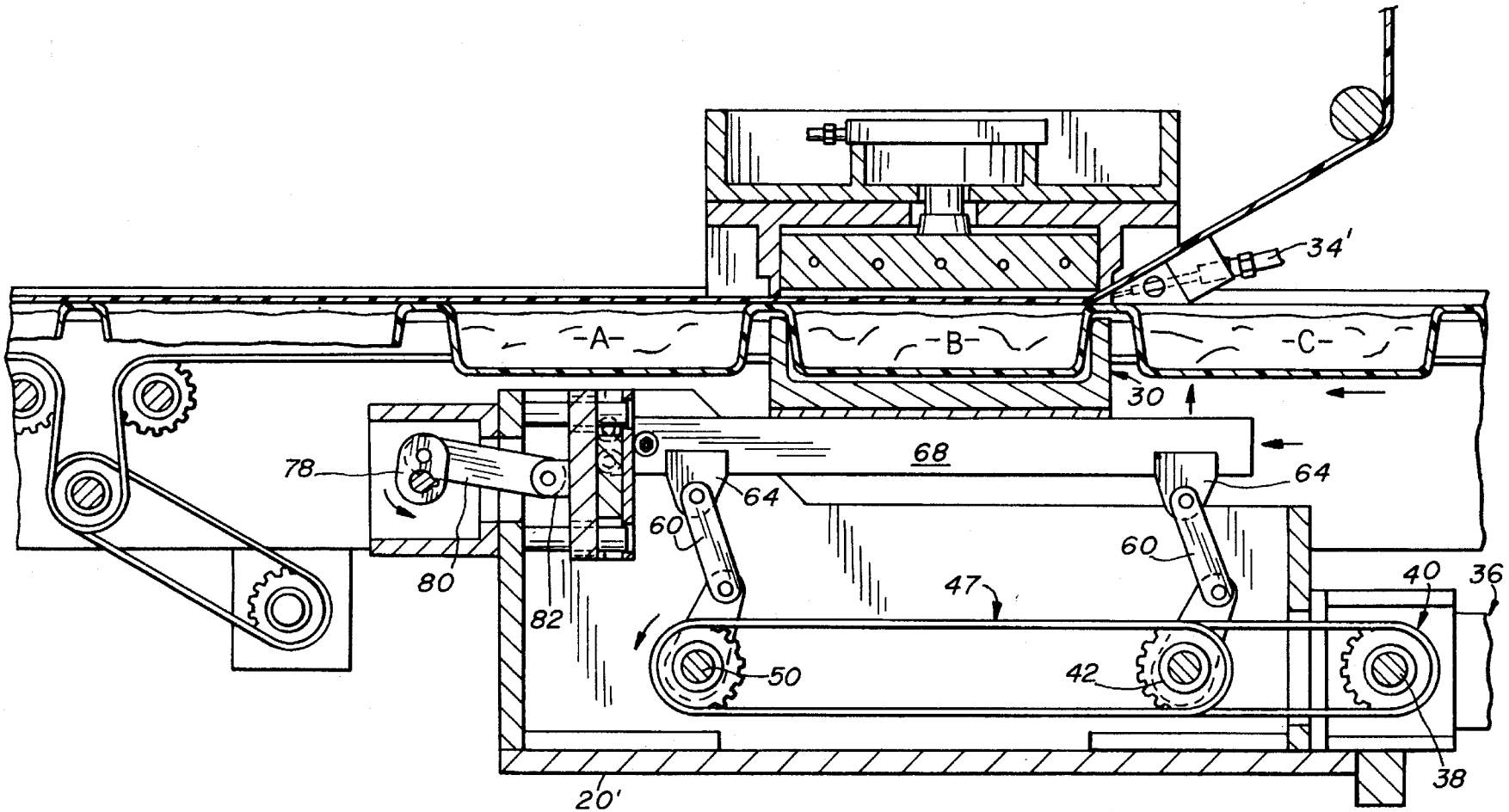
FIG. 7 is a longitudinal, cross-sectional view similar to that of FIG. 6, with the tool thereof having been raised into close proximity to the film positioned thereabove for again performing work.

After the work by the tool has been completed, the conveyer-chain is actuated to move the film for indexing to the next station. Simultaneously therewith, the drive motor 40 is driven in the opposite direction to start lowering the tool 30, as seen in FIG. 5, while the horizontal drive mechanism's motor is again actuated to move the tool leftwardly, as seen in FIG. 5, at approximately the same speed as the conveyer chain, so that, while the tool is being lowered, it is traveling downstream along with the conveyer at approximately the same speed as the film. This allows for the earlier actuation of the conveyer. In the conventional method, the conveyer is not able to be actuated for indexing until after the tool had been completely lowered below the bottom of the vacuum-packages. According to the invention, earlier actuation of the conveyer is possible, since the tool is moved in the same direction at approximately the same speed as the conveyer, while the vertical drive mechanism is lowering the tool. At the point where the vertical drive mechanism has lowered the tool enough whereby clearance is allowed for the passage of the vacuum-package, as seen in FIG. 5, the horizontal drive mechanism will have moved the tool to its farthest, downstream position, where the links 78 and 80 are horizontally parallel. While the chain is indexing another series of packages to the sealing or forming station, the vertical drive motor 40 is stopped, and the horizontal drive mechanism begins moving the tool 30 horizontally upstream, or to the right when viewing FIG. 6. When the tool reaches its farthest upstream movement, as seen in FIG. 6, the Vertical drive motor 40 is again actuated in the opposite direction to start raising the tool again for performing its work, as seen in FIG. 6. At this stage, the horizontal drive mechanism starts moving the tool in the downstream direction, or to the left when viewing FIG. 6. The tool is moved at approximately the same speed as the conveyer, while the tool is also being lifted toward the conveyer by the vertical drive mechanism, as seen in FIG. 7. At the point in time when the conveyer has stopped at the station, the tool 30 will be in its uppermost, work-performing position in contact with the film, while being positioned approximately midway between its extreme upstream and downstream positions. Since the tool is being moved horizontally downstream with the conveyer before the conveyer has stopped for having the work performed at the station, the tool may be lifted earlier than would otherwise be possible, allowing the tool to be positioned about the bottom pocket-receptacle of the package about to be sealed, without causing an obstruction to the movement of the packages. When the tool has been lifted its maximum amount, the state at the station returns to that as depicted FIG. 2.

All of the servo-motors of the vacuum-packaging machine may be computer-controlled, such as by a Delta Tau Data System, manufacture by Delta Tau, Inc. of Canoga Park, Calif. This computer system will control all of the activations and deactivations of all of the motors of the packaging machine. There are a total of at least five such servo-motors that must be controlled by the computer: Two at each of the sealing and forming stations, and the film-conveyer motor. With such computer-control of the motors, the processing time at each of the sealing and forming stations may be reduced by as much as one-half, and more in some cases, as compared to the conventional packaging machine.

While a specific embodiment of the invention has been shown and described, it is to be understood that numerous changes and modifications may be made therein without departing from the scope, spirit and intent of the invention as set forth in the appended claims.

What I claim is:

1. In a package-forming machine comprising at least a forming station, a sealing station, a supply of film used for forming packages, and conveyer means for indexing the film to said stations, said conveyor means stationarily positioning said film at said forming station and said sealing station; each of said forming and sealing stations comprising a tool for performing work on the film at the respective said station when said film is stationarily positioned thereat, and vertical drive means for raising and lowering the respective said tool with respect to said conveyor means and said film, wherein the improvement comprises:

each of said forming and sealing stations further comprising horizontal drive means for moving the respective said tool in the horizontal direction parallel to the movement of said conveyor means;

said horizontal drive means stationarily positioning the respective said tool against said film while said respective tool is performing work thereon.

2. The package-forming machine according to claim 1, wherein each said horizontal drive means reciprocates the respective said tool in the upstream and downstream directions, and stationarily positions the respective said tool against said film while said respective tool is performing work thereon during at least a portion of the dwell time of said film at the respective said station.

3. The package-forming machine according to claim 1, wherein said horizontal drive means and said vertical drive means are both coupled to said tool in order to provide compound horizontal and vertical movement to said tool, and in order to stationarily position the respective said tool against said film while said respective tool is performing work thereon during at least a portion of the dwell time of said film at the respective said station.

4. The package-forming machine according to claim 1, wherein said vertical drive mechanism comprises a reversible drive motor, at least one first intermediate linkage, at least one second connecting linkage pivotally connected to said at least one first intermediate linkage, means pivotally connected to said at least one first intermediate linkage for drivingly coupling said drive motor to said at least one first intermediate linkage, and at least one tool-connecting plate pivotally connected to said at least one second connecting linkage, said at least one tool-connecting plate being affixed to the respective said tool, whereby upon rotation of said drive motor in one direction, said tool is raised, and upon rotation of said drive motor in the opposite direction, said tool is lowered.

5. The package-forming machine according to claim 1, wherein said vertical drive mechanism comprises a reversible drive, and vertical-drive linkage means coupling said drive to the respective said tool, whereby upon rotation of said drive in one direction, said tool is raised, and upon rotation of said drive in the opposite direction, said tool is lowered, and, upon deactivation of said reversible drive, stationarily positions the respective said tool against said film while said respective tool is performing work thereon during at least a portion of the dwell time of said film at the respective said station.

6. The package-forming machine according to claim 1, wherein said horizontal drive mechanism comprises a drive motor, and horizontal-drive linkage means coupling said drive motor to the respective said tool, whereby upon rotation of said drive motor, said tool is caused to undergo reciprocal horizontal motion, and, upon deactivation of said drive motor, stationarily positions the respective said tool against said film while said respective tool is performing work thereon during at least a portion of the dwell time of said film at the respective said station.

7. The package-forming machine according to claim 6, wherein said horizontal-drive linkage means comprises an intermediate linkage drive, a push-plate, and at least one guide-rod along which said push-plate is reciprocated by said intermediate linkage drive; said push plate having at least one vertical, roller-guide plate; each respective tool comprising roller means for vertically guiding the respective said tool along said at least one roller-guide plate, whereby when said horizontal drive mechanism reciprocates the respective said tool in the horizontal directions, said vertical drive mechanism may simultaneously vertically reciprocally move the respective said tool.

8. The package-forming machine according to claim 1, wherein both of said horizontal and vertical drive mechanisms are operatively coupled to the respective said tool for simultaneously imparting to the tool both horizontal and vertical movement.

9. The package-forming machine according to claim 8, wherein said horizontal drive mechanism drives the tool in the same direction and at approximately the same speed as said conveyor means immediately before said conveyor means comes to a stop for positioning the film at a respective station; whereby said vertical drive mechanism may move said tool toward said film before said conveyor means comes to a stop.

10. The package-forming machine according to claim 9, wherein, after the tool has performed its work on the film, said horizontal drive means moves said tool in the horizontal downstream direction along with said conveyer means at approximately the same speed as said conveyer means, while said vertical drive means simultaneously moves said tool away from said film, whereby said conveyer means may be actuated earlier to index the film.

11. In a process-station of a package-forming machine comprising a movable tool for performing work on film indexed to the station, the improvement comprising;

drive means operatively coupled to said tool for imparting to said tool simultaneous combined vertical and horizontal motion, whereby said tool may be brought into working contact with film indexed at the station, said film being capable of being indexed away from the station and out of working contact with said tool before said conveyor means comes to a stop;

said drive means comprising a vertical drive mechanism comprising a reversible drive motor, at least one first intermediate linkage, at least one second connecting linkage pivotally connected to said at least one first intermediate linkage, means pivotally connected to said at least one first intermediate linkage for drivingly coupling said drive motor to said at least one first intermediate linkage, and at least one tool-connecting plate pivotally connected to said at least one second connecting linkage, said at least one tool-connecting plate being affixed to the respective said tool, whereby upon rotation of said drive motor in one direction, said tool is raised, and upon rotation of said drive motor in the opposite direction, said tool is lowered.

12. A drive mechanism for moving a tool operatively coupled thereto, comprising;

drive means for imparting simultaneous combined vertical and horizontal motion;

said drive means comprising a vertical drive mechanism comprising a first drive, and vertical-drive linkage means coupling said first drive to a tool for moving the tool in a reciprocating vertical direction;

said drive means further comprising a horizontal drive mechanism comprising a second drive, and horizontal-drive linkage means coupling said second drive to a tool, whereby upon actuation of said second drive, the tool is caused to undergo reciprocal horizontal motion;

said horizontal drive mechanism being coupled to the tool at a location different from that to which said vertical drive mechanism is coupled to the tool;

said vertical drive mechanism comprising a reversible drive motor, at least one first intermediate linkage, at least one second connecting linkage pivotally connected to said at least one first intermediate linkage, means pivotally connected to said at least one first intermediate linkage for drivingly coupling said drive motor to said at least one first intermediate linkage, and at least one tool-connecting plate pivotally connected to said at least one second connecting linkage, said at least one tool-connecting plate being affixed to a tool, whereby upon rotation of said drive motor in one direction, a tool is raised, and upon rotation of said drive motor in the opposite direction, the tool is lowered.

13. A drive mechanism for moving a tool operatively coupled thereto, comprising:

drive means for imparting simultaneous combined vertical and horizontal motion;

said drive means comprising a vertical drive mechanism comprising a first drive, and vertical-drive linkage means coupling said first drive to a tool for moving the tool in a reciprocating vertical direction;

said drive means further comprising a horizontal drive mechanism comprising a second drive, and horizontal-drive linkage means coupling said second drive to a tool, whereby upon actuation of said second drive, the tool is caused to undergo reciprocal horizontal motion;

said horizontal drive mechanism being coupled to the tool at a location different from that to which said vertical drive mechanism is coupled to the tool;

a tool affixed to said horizontal and vertical drive mechanisms; said horizontal-drive linkage means comprising an intermediate linkage drive, a push-plate, and at least one guide-rod along which said push-plate is reciprocated by said intermediate linkage drive; said push plate having at least one vertical, roller-guide plate; said tool comprising roller means for operative engagement with said at least one vertical, roller-guide plate for allowing said tool to be vertically guided along said at least one roller-guide plate, whereby, when said horizontal drive means reciprocates said tool in the horizontal direction, said vertical drive means simultaneously vertically reciprocates said tool.

14. A method of reducing the dwell time of a tool at a forming or sealing station of a packaging machine comprising:

(a) conveying film from which the package is made to the station;

(b) stopping the film at the station;

(c) processing the film at the station by means of the tool thereat;

(d) after said step (c) has been completed, conveying the film processed at the station in the downstream direction away from the station;

(e) substantially at the same time that said step (d) is commenced, translating the tool at least partially in the same, downstream direction as the film is conveyed during said step (d);

(f) at least during part of said step (e), moving the tool away from the film until at least the tool clears the film;

(g) before said step (b), at least translating the tool in the upstream direction with the tool positioned near the conveyed film; and, thereafter, (h) moving the tool in the downstream direction along with and toward the conveyed film until said steps (b) and (c) and performed, whereby the tool may be activated before the conveyed film comes to a stop and brought into working contact with the film after the film has stopped at the station; and (h) after said step (h), stationarily positioning the tool at the station and in contact against the film for carrying out said step (c).

15. The method of reducing the dwell time of a tool at a forming or sealing station of a packaging machine according to claim 14, wherein the speed at which the tool is translated in said step (e) is approximately equal to the speed at which the film is conveyed during said step (d).

* * * * *